US005455592A

United States Patent [19]

Huddle

[11] Patent Number: 5,455,592

[45] Date of Patent: Oct. 3, 1995

[54] METHOD AND APPARATUS FOR CALIBRATING AN ANTENNA ARRAY

[75] Inventor: James R. Huddle, Chatsworth, Calif.

[73] Assignee: Litton Systems, Inc., Beverly Hills, Calif.

[21] Appl. No.: 305,271

[22] Filed: Sep. 13, 1994

[51] Int. Cl.[6] ..... H01Q 3/00

[52] U.S. Cl. ..... 342/359; 342/174

[58] Field of Search ..... 342/359, 360, 342/173, 174

[56] References Cited

U.S. PATENT DOCUMENTS

| | | | |
|---|---|---|---|
| 5,089,824 | 2/1992 | Uematsu et al. | 342/359 |
| 5,245,348 | 9/1993 | Nishikawa et al. | 342/359 |

*Primary Examiner*—Theodore M. Blum
*Attorney, Agent, or Firm*—Robert E. Malm

[57] ABSTRACT

The invention is a method and apparatus for determining the errors in the orientation coordinates of an antenna array and the spacings of the antennas in the array using radio waves from one or more sources having known positions and an inertial system, the antenna array comprising at least two antennas. The method comprises the steps of placing the antenna array in one or more specified orientations relative to a reference coordinate system, measuring the phase of each radio wave received by each of the antennas in the antenna array from the one or more radio-wave sources for each orientation of the antenna array, and then determining the errors in the array orientation coordinates using the measured phases. The method also includes determining the errors in the spacings of the antennas in the array and determining the errors in the orientation coordinates of the reference coordinate system, in both cases using the measured phases. The invention also includes apparatus for practicing the method utilizing an inertial system for maintaining the reference coordinate system.

20 Claims, 7 Drawing Sheets

$$\bar{L} = L\begin{bmatrix}1\\0\\0\end{bmatrix} = \begin{bmatrix}1 & (\phi_Z+\gamma_Z) & -(\phi_N+\gamma_y)\\ -(\phi_Z+\gamma_Z) & 1 & \phi_E\\ (\phi_N+\gamma_y) & -\phi_E & 1\end{bmatrix}\begin{bmatrix}E\\N\\U\end{bmatrix}$$

$$\bar{L} = L\begin{bmatrix}1\\0\\0\end{bmatrix} = \begin{bmatrix} -(\phi_Z+\gamma_Z) & 1 & (\phi_E-\gamma_y) \\ -1 & -(\phi_Z+\gamma_Z) & \phi_N \\ \phi_N & -(\phi_E-\gamma_y) & 1 \end{bmatrix}\begin{bmatrix}E\\N\\U\end{bmatrix}$$

$$\bar{L} = L\begin{bmatrix}1\\0\\0\end{bmatrix} = \begin{bmatrix}-(\phi_N+\gamma_y) & (\phi_E+\gamma_z) & -1\\ -\phi_z & 1 & (\phi_E+\gamma_z)\\ 1 & \phi_z & -(\phi_N+\gamma_y)\end{bmatrix}\begin{bmatrix}E\\N\\U\end{bmatrix}$$

$$\bar{L} = L\begin{bmatrix}1\\0\\0\end{bmatrix} = \begin{bmatrix}-(\phi_N+\gamma_z) & (\phi_E-\gamma_y) & -1\\ -1 & -\phi_z & (\phi_N+\gamma_z)\\ -\phi_z & 1 & (\phi_E-\gamma_y)\end{bmatrix}\begin{bmatrix}E\\N\\U\end{bmatrix}$$

| Direction of Arrival | Antenna Baseline Orientation Number | | | |
|---|---|---|---|---|
| | 1 | 2 | 3 | 4 |
| East | $\delta L$ | $-(\phi_Z+\gamma_Z)$ | $-(\phi_N+\gamma_y)$ | $-(\phi_N+\gamma_Z)$ |
| North | $(\phi_Z+\gamma_Z)$ | $\delta L$ | $(\phi_E+\gamma_Z)$ | $(\phi_E-\gamma_y)$ |
| Vertical | $-(\phi_N+\gamma_y)$ | $(\phi_E-\gamma_y)$ | $\delta L$ | $\delta L$ |

METHOD AND APPARATUS FOR CALIBRATING AN ANTENNA ARRAY

BACKGROUND OF INVENTION

This invention is generally related to integrated radio-inertial navigation systems and more specifically to integrated radio-inertial navigation systems that incorporate a means for measuring the attitude of vehicles which utilize the systems.

The Global Positioning System (GPS), the modern version of a radio navigation system, consists of 24 globally-dispersed satellites with synchronized atomic clocks. Each satellite transmits a coded signal having the satellite clock time embedded in the signal and carrying information concerning the emphemerides of the satellites and its own daily emphemeris and clock corrections. A user obtains the essential data for determining his position and clock error by measuring the differences in his receiver clock time and the satellite clock times embedded in the signals from at least four viewable satellites. The difference in receiver clock time and satellite clock time multiplied by the radio-wave propagation velocity is called the pseudorange and is equal to the range to the satellite plus the incremental range equivalent of satellite clock error minus the receiver clock error.

The user also obtains the essential data for determining his velocity by measuring for each satellite the difference in the frequency of the actual satellite signal and the frequency of the satellite signal if it had been generated using the receiver clock. The accumulated change in phase over a fixed period of time resulting from this frequency difference expressed in units of distance is called the delta range and is equal to the change in satellite range over the fixed period of time plus the change in the difference in the receiver and satellite clocks over the same fixed period of time multiplied by the radio-wave propagation velocity.

The user, knowing the positions, velocities, and clock errors of the satellites, can compute his own position, velocity, and clock error from the measured pseudoranges and delta ranges.

Since the more significant errors in GPS-determined positions of nearby platforms are highly correlated, these errors tend to cancel out in determining the relative positions of the platforms. The use of GPS for making highly-accurate relative position determinations of nearby platforms is referred to as differential GPS.

The accuracy attainable with differential GPS suggests the use of interferometric GPS for determining the attitude of a platform. Interferometric GPS denotes the use of satellite signal carrier phase measurements at different points on a platform for accurately determining the orientation of the platform.

The use of three spatially-distributed antennas on a platform permits the accurate determination with GPS signals alone of pitch, roll, and heading. However, if the platform is a highly-maneuverable aircraft, it becomes necessary to integrate the platform GPS equipment with an inertial navigation unit to provide high bandwidth and accurate measurements of vehicle orientation with respect to an earth-referenced or inertial space-referenced coordinate frame. GPS compensates for inertial navigation system drifts and when platform maneuvering or other occurrences causes GPS to become temporarily inoperative, the inertial navigation system (INS) carries on until the GPS again becomes operative.

The utilization of an INS in combination with the GPS permits the attitude of a vehicle or some other object to be determined with antenna arrays consisting of as few as two antennas and with performance attributes that are superior to those that can be obtained with INS or GPS used separately.

In order to measure attitude with an integrated INS/GPS, the position and orientation of the antenna array must be known accurately in the inertial reference coordinate system. The present invention provides a method and apparatus for obtaining this information.

BRIEF SUMMARY OF INVENTION

The invention is a method and apparatus for determining the errors in the orientation coordinates of an antenna array using radio waves from one or more sources having known positions, the antenna array comprising at least two antennas. The method comprises the steps of placing the antenna array in one or more specified orientations relative to a reference coordinate system, measuring the phase of each radio wave received by each of the antennas in the antenna array from the one or more radio-wave sources for each orientation of the antenna array, and then determining the errors in the array orientation coordinates using the measured phases.

The method also includes determining the errors in the spacings of the antennas in the array and determining the errors in the orientation coordinates of the reference coordinate system, in both cases using the measured phases.

The invention also includes apparatus for practicing the method.

DESCRIPTION OF THE PREFERRED EMBODIMENT

The melding of an inertial system and GPS begins with the mounting of a GPS receiving antenna array on the enclosing case of an inertial system containing an inertial instrument (i.e. gyros and accelerometers) sensor assembly. The orientation of the antenna array relative to the sensing axes of the inertial instrument is approximately known simply as a result of the design and assembly process of both the inertial system and the antenna array. The function of this invention is to remove the uncertainty in orientation of the inertial instrument reference coordinate frame and the antenna array reference coordinate frame as well as the uncertainties in distance between the phase centers of the antennas in the antenna array by appropriate measurements utilizing the resources of the inertial system and GPS.

Figure 1:
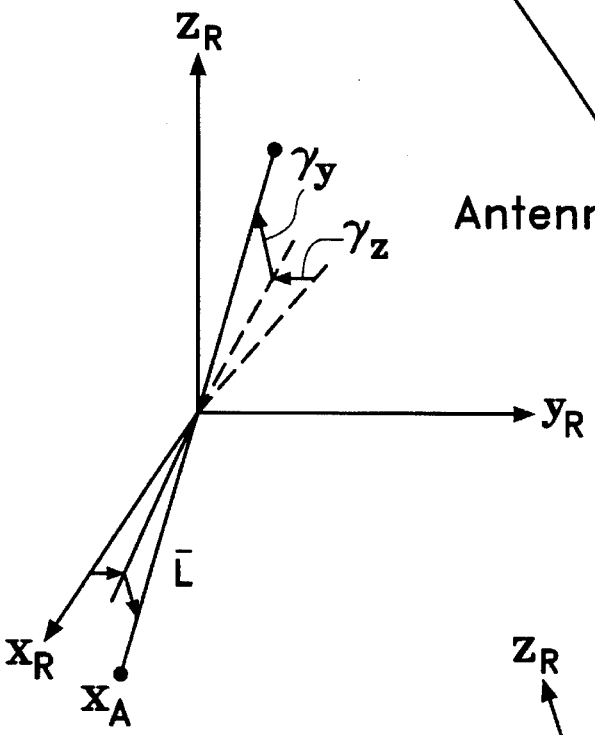
FIG. 1 defines the errors in the orientation coordinates of a two-element antenna array with reference to the inertial reference coordinate system.

For purposes of illustration a two-antenna array will be assumed that is nominally aligned with the $x_R$-axis in the inertial reference coordinate system, as shown in FIG. 1. The inertial reference coordinates are denoted by $x_R$, $y_R$, and $z_R$. The orientation of the antenna array will be referenced to an antenna coordinate system with coordinates denoted by $x_A$, $y_A$, and $z_A$. The The two-antenna array, represented by the vector $\bar{L}$, is aligned with the $x_A$-axis. The angles specify the orientation of the antenna array relative to the reference coordinates of the inertial instruments in terms of a rotation about the $z_R$-axis by an angle $\gamma_Z$ and a rotation about the $y_R$-axis by an angle $\gamma_y$. The spacing between the two antennas is denoted by the symbol L.

Figure 2:
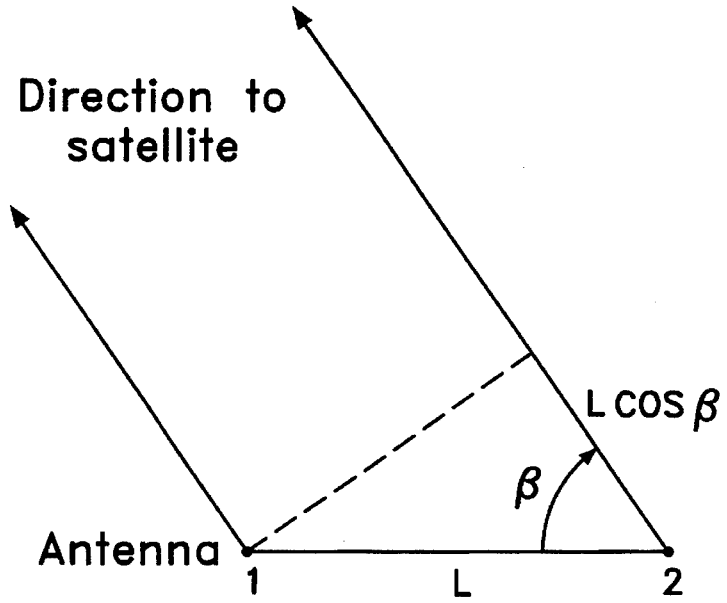
FIG. 2 illustrates the principle involved in determining the orientation of an antenna array from the difference in phases of a radio wave received by two antennas.

The geometry for the reception of a satellite radio signal at two antennas is illustrated in FIG. 2. The difference $\Delta\phi$ in the phases $\phi_1$ and $\phi_2$ of the signals received at antennas 1 and 2 respectively is given by the equation $$\Delta\phi = \frac{2\pi L}{\lambda} \cos\beta \tag{1}$$

where L is the spacing between the two antennas, $\lambda$ is the wavelength of the radio wave, and $\beta$ is the angle between the antenna baseline and the direction of arrival of the radio wave.

An error $\delta L$ in the antenna spacing results in an error $\delta\beta$ in the direction of arrival of the radio wave given by the equation $$\delta\beta = \frac{\delta L}{L} \, ctn\beta \tag{2}$$

It is evident from equation (2) that for $\beta=\pi/2$, the error in spacing produces no error in the determination of angular direction, i.e. $\delta\beta=0$. It is also evident that as $\beta$ approaches 0 or $\pi$, the spacing error produces an extremely large error in the direction of arrival. These characteristics suggest (1) measuring the orientation of the antenna array when the array is perpendicular to the direction of arrival when an error in antenna spacing has little effect on the measurement and (2) measuring the spacing of the antennas when the array is parallel to the direction of arrival when an error in antenna array orientation has little effect on the measurement.

Figure 3:
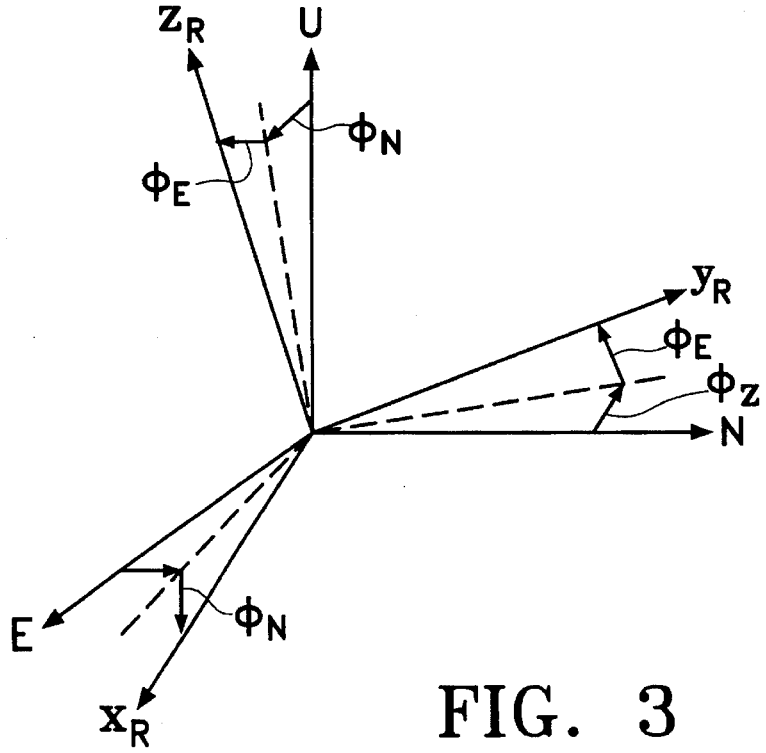
FIG. 3 defines the errors in the orientation coordinates of the inertial reference coordinate system with reference to a local geodetic coordinate system.

After an inertial system has been aligned with respect to local geodetic coordinates E (east), N (north), and U (vertical), there exists in general three small orientation errors as illustrated in FIG. 3. The angle $\phi_N$ denotes a rotation about the N-axis. The angle $\phi_E$ denotes a rotation about the E-axis. And the angle $\phi_Z$ denotes a rotation about the $z_R$-axis.

For simplicity, the inertial system coordinate axes are shown misaligned with respect to the geodetic axes. The inertial system coordinate axes are in general at a substantially different orientation with respect to the geodetic coordinate axes but still misaligned by the vector equivalent of the small angular errors shown in FIG. 3.

Figures 4, 5:
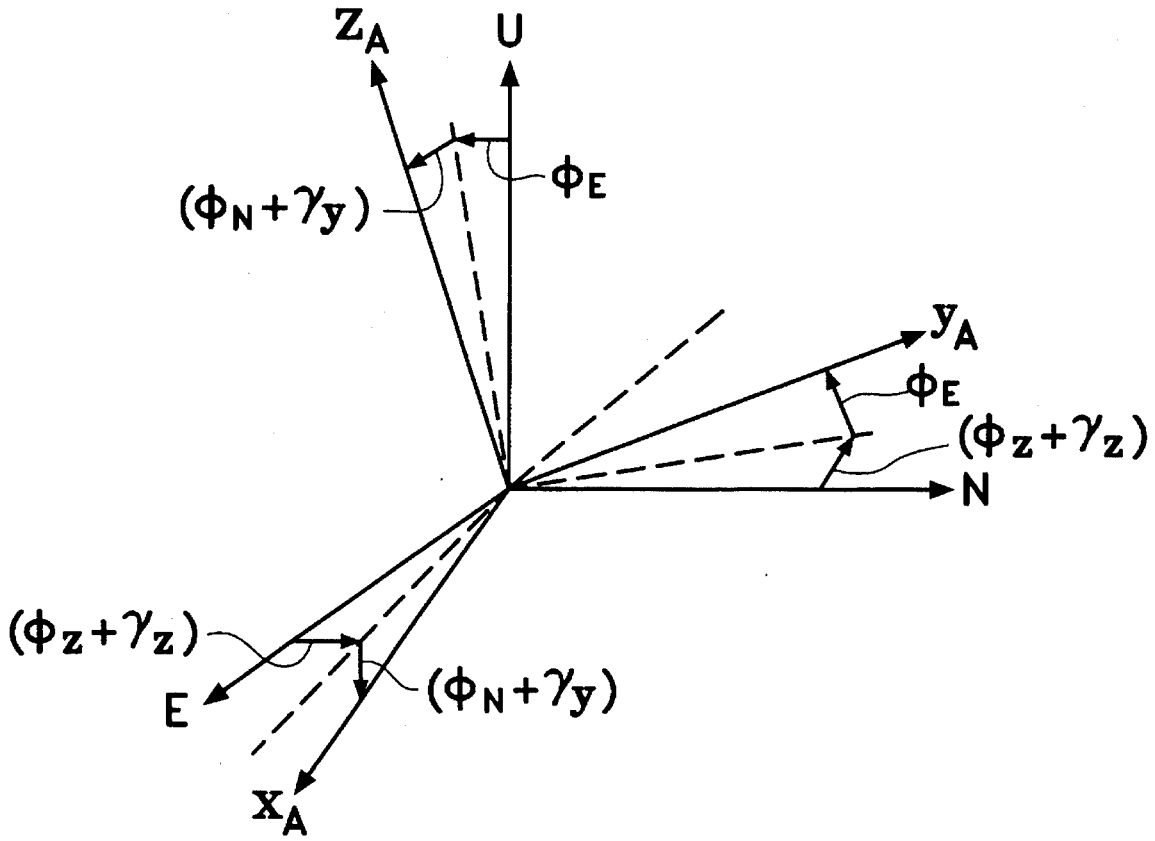
FIG. 4 defines the matrix transformation from geodetic coordinates to antenna array coordinates for the first orientation of the antenna array.
FIG. 5 illustrates the first orientation of the antenna array with respect to a local geodetic coordinate system, FIG. 6 defines the matrix transformation from geodetic coordinates to antenna array coordinates for the second orientation of the antenna array.

For the orientation of the inertial reference frame shown in FIG. 3, the orientation of the antenna baseline is given by the expression shown in FIG. 4 and illustrated in FIG. 5. A consideration of the effect of direction of arrival with the inertial reference frame in this orientation provides insight as to what the measurement possibilities are.

When the direction of arrival is from the north (along the N-axis of FIG. 5), the direction of arrival is nearly perpendicular to the antenna baseline which is aligned with the $x_A$-axis. It is apparent from FIG. 5 that under these conditions, the quantity $(\phi_N+\gamma_y)$ has no significant effect on the difference in phase of the signals received at the two antennas and thus cannot be determined by measuring the difference in phase of the two antenna signals.

It is also apparent that the quantity $(\phi_Z+\gamma_Z)$ directly affects the difference in phase of the two antenna signals and can be determined by measuring the phase difference.

As mentioned previously in connection with equation (2), the fact that the direction of arrival is perpendicular to the antenna baseline means that the phase difference that provides the basis for calculating the quantity $(\phi_Z+\gamma_Z)$ is not significantly affected by errors in antenna spacing.

When the direction of arrival is vertical (along the U-axis of FIG. 5), the direction of arrival is again nearly perpendicular to the antenna baseline. It is apparent from FIG. 5 that under these conditions, the quantity $(\phi_Z+\gamma_Z)$ has no significant effect on the difference in phase of the signals received at the two antennas and thus cannot be determined by measuring the difference in phase of the two antenna signals.

It is also apparent that the quantity $(\phi_N+\gamma_y)$ directly affects the difference in phase of the two antenna signals and can be determined by measuring the phase difference.

As mentioned above, the fact that the direction of arrival is perpendicular to the antenna baseline means that the phase difference that provides the basis for calculating the quantity $(\phi_N+\gamma_y)$ is not significantly affected by errors in antenna spacing.

Finally, when the direction of arrival is from the east (along the E-axis of FIG. 5), the direction of arrival is nearly parallel to the antenna baseline. It is apparent from FIG. 5 that under these conditions, the quantities $(\phi_N+\gamma_y)$ and $(\phi_Z+_{65\ Z})$ have no significant effect on the difference in phase of the signals received at the two antennas and thus cannot be determined by measuring the difference in phase of the two antenna signals.

It is also apparent that the antenna spacing L directly affects the difference in phase of the two antenna signals and can be determined by measuring the phase difference.

Clearly, if satellites or other sources of radio waves in the three orthogonal directions discussed above were available, the quantities $(\phi_N+\gamma_y)$ $\delta L$ (the error in L) could all be determined.

Another way of accomplishing the same result is to observe the signal from a single satellite or other radio-wave source for four different orientations of the inertial system and the attached antenna array, the first orientation being the one shown in FIG. 5.

Figures 6, 7:
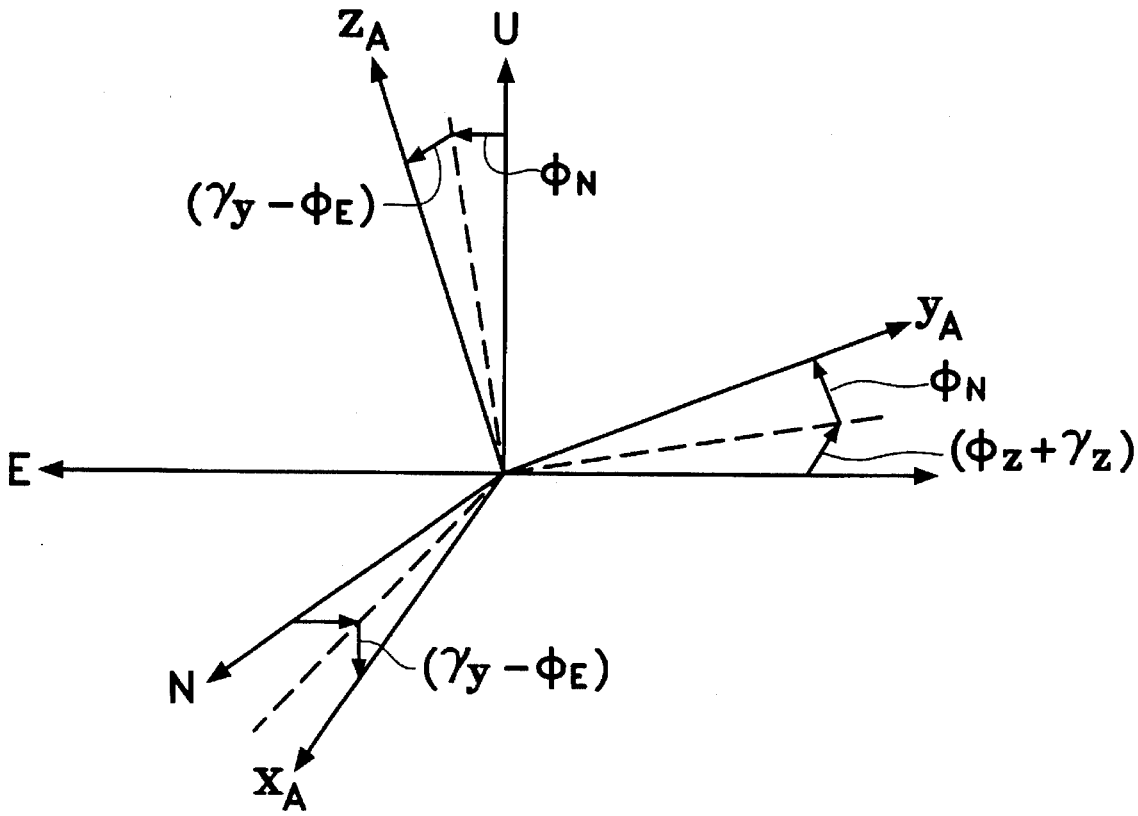
FIG. 7 illustrates the second orientation of the antenna array with respect to a local geodetic coordinate system.

The second orientation of the inertial system is obtained by rotating the inertial frame in the first orientation (FIG. 5) by 90 degrees about the U or $z_{R\ axis}$, i.e. $x_R$ to N and $y_R$ to –E. The orientation of the antenna baseline for the second orientation of the inertial system is given by the expression shown in FIG. 6 and illustrated in FIG. 7. Note that the orientation errors of the antenna baseline rotate with the inertial coordinate frame whereas the inertial system orientation errors remain fixed with respect to the geodetic coordinate frame.

Figures 8, 9:
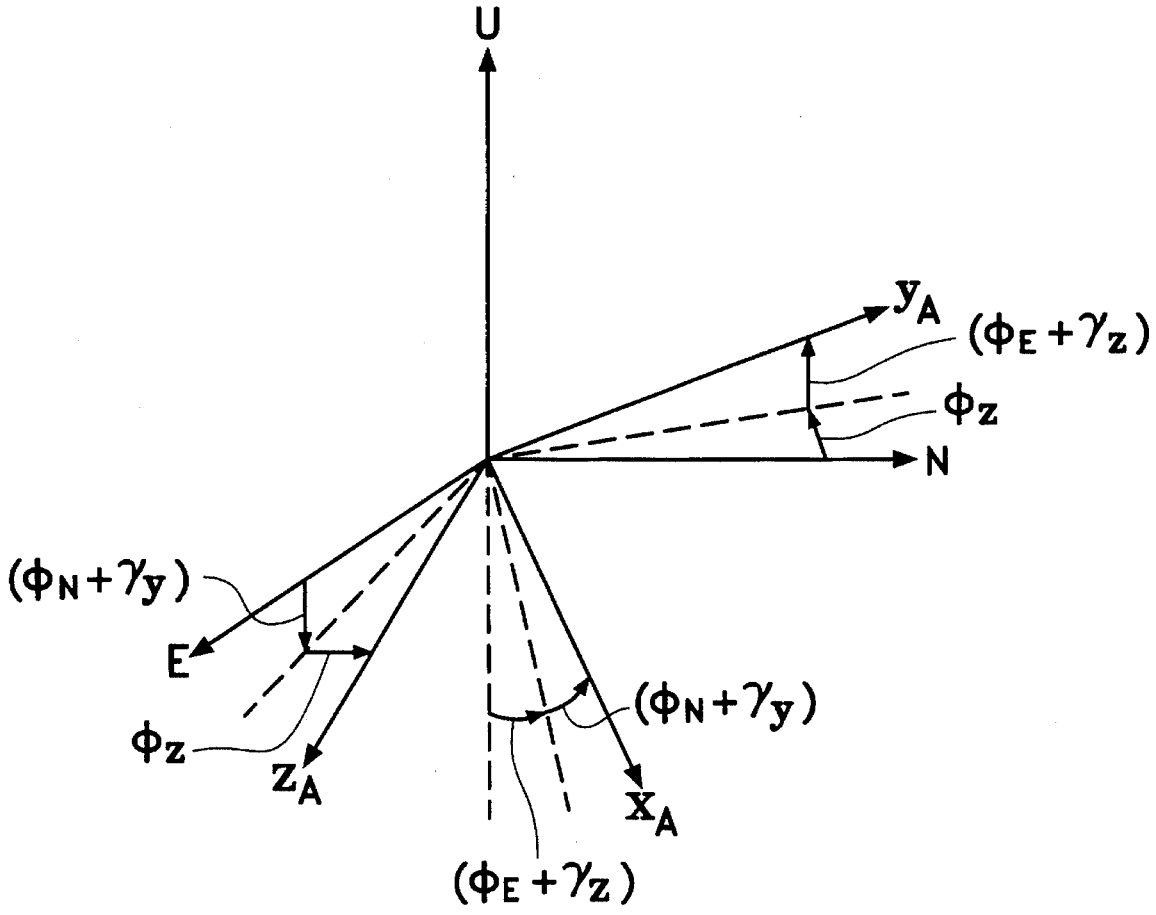
FIG. 8 defines the matrix transformation from geodetic coordinates to antenna array coordinates for the third orientation of the antenna array.
FIG. 9 illustrates the third orientation of the antenna array with respect to a local geodetic coordinate system.

The third orientation of the inertial system is obtained by rotating the inertial system in the first orientation by 90 degrees about the N or $y_R$axis, i.e. $z_R$ to E and $x_R$to –U. The orientation of the antenna baseline for the third orientation of the inertial system is given by the expression shown in FIG. 8 and illustrated in FIG. 9.

Figures 10, 11:
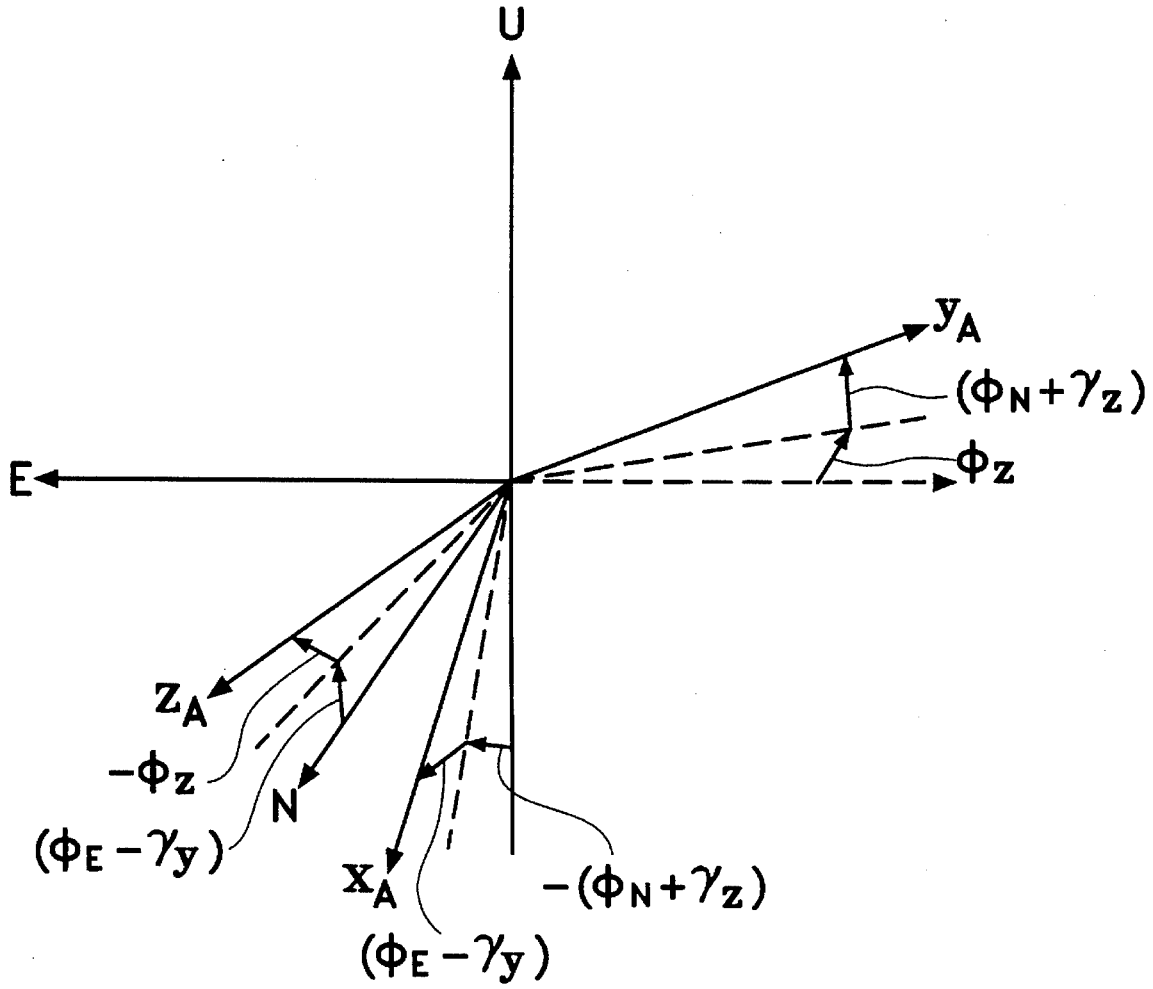
FIG. 10 defines the matrix transformation from geodetic coordinates to antenna array coordinates for the fourth orientation of the antenna array.
FIG. 11 illustrates the fourth orientation of the antenna array with respect to a local geodetic coordinate system.

The fourth orientation of the inertial system is obtained by rotating the inertial system in the second orientation by 90 degrees about the –E or $y_R$ axis, i.e. $z_R$ to N and $x_R$ to –U. The orientation of the antenna baseline for the fourth orientation of the inertial system is given by the expression shown in FIG. 10 and illustrated in FIG. 11.

Figures 12, 13:
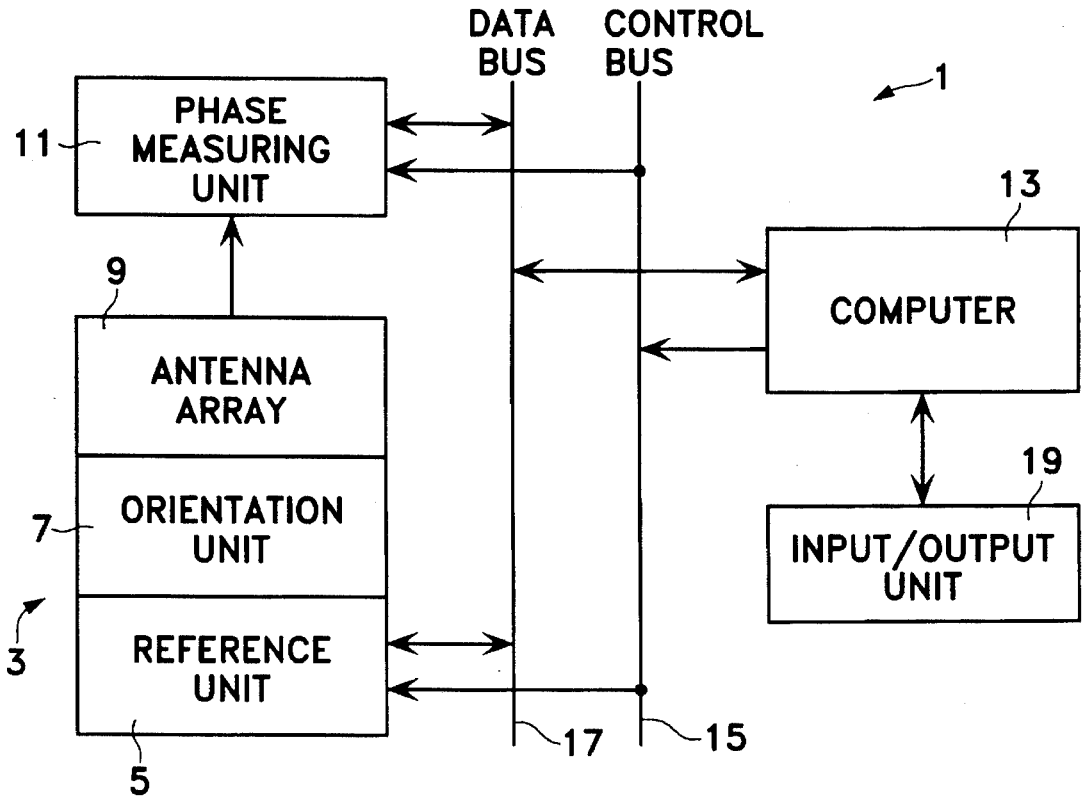
FIG. 12 indicates the orientation errors that can be determined as a function the direction of arrival of a radio wave and the orientation of the antenna baseline
FIG. 13 shows a block diagram of the invention.

The quantities that can be determined as a function of direction of arrival of a radio wave and the orientation of the inertial system are indicated in FIG. 12. The three error parameters that must be determined to "calibrate" the antenna baseline with respect to the inertial reference coordinate system are $\delta L$, $\gamma_y$, and $\gamma_z$. The three error parameters that must be determined to ascertain the orientation of the antenna baseline with respect to the geodetic coordinate system and also to ascertain the orientation of the inertial reference coordinate system with respect to the geodetic coordinate system are $\phi_E$, $\phi_N$, and $\phi_Z$.

The rotation about the axis U between the first and second orientations of the inertial system results in a decorrelation between the accelerometer biases in the level plane (which rotate with the inertial reference system coordinate axes) and the inertial system tilts $\phi_E$ and $\phi_N$, This permits the accelerometer biases projected into the level plane to be calibrated and the tilts to be essentially eliminated using null velocity updates in the normal inertial system alignment procedure. Hence, a fully-calibrated alignment of the inertial system and the antenna baseline with respect to local geodetic coordinates requires the determination of only the four remaining error parameters $\phi_Z$, $\delta L$, $\gamma_y$, and $\gamma_Z$.

These error parameters can individually be observed by rotating the inertial reference system and attached antenna array with respect to an available radio-wave source. The inertial system provides the means for accomplishing precise changes in the orientation of the antenna array.

The data contained in FIG. 12 provides a comprehensive guide for the development of calibration procedures depending on the availability of satellites and other radio-wave sources for observation. There is no requirement that the radio-wave sources be available in the specific directions east, north, and vertical indicated in FIG. 12. It is only necessary that they be available in particular directions with respect to the antenna baseline. The initial antenna baseline with respect to local geodetic coordinates is entirely arbitrary and can be selected for convenience in observing the signals from particular radio-wave sources that are available. The inertial system provides the flexibility and ease of use in implementing a calibration process and is essential in maintaining a reference to local geodetic coordinates as the antenna baseline is rotated to different orientations. The four orientations defined above relative to local geodetic coordinates were only selected to facilitate explanation of methods of calibration.

To illustrate the application of the general principles defined herein to the derivation of specific calibration procedures under specific conditions, the calibration procedure appropriate for the situation where only one radio-wave source is available will now be described. It can be assumed, without loss of generality, that the direction of arrival of the radio wave is from the north, thereby permitting the use of the data in FIG. 12.

The objective is to define a sequence of antenna baseline positions such that the three residual orientation errors of the inertial system $\phi_E$, $\phi_N$, and $\phi_Z$ and the three residual calibration errors of the antenna baseline $\delta L$, $\gamma_y$, and $\gamma_Z$ are determined such that the orientation of the antenna baseline and inertial system are known with high accuracy with respect to the local geodetic coordinates.

For this example, the sequence 1, 2, and 3 of orientations is advantageous in that the inertial system orientation with respect to the local geodetic coordinates is obtained, a prime objective in most cases, and the antenna baseline is partially calibrated.

From FIG. 12, a north direction of arrival with the inertial system/antenna baseline in orientation #1, the quantity $(\phi_Z+\gamma_Z)$ is obtained.

Rotation to orientation #2 results in the measurement of the tilts $\phi_E$ and $\phi_N$ by the normal inertial system alignment procedure. A north direction of arrival with inertial system/antenna baseline in orientation #2, according to FIG. 12, permits the error $\delta L$ in antenna spacing to be determined.

A north direction of arrival with inertial system/antenna baseline in orientation #3, according to FIG. 12, permits the quantity $(\phi_E+\gamma_Z)$ to be determined. Since the tilt $\phi_E$ has been determined, $\gamma_Z$ can be calculated. The quantity $\gamma_Z$ can then be subtracted from the quantity $(\phi_Z+\gamma_Z)$ to obtain $\phi_Z$.

Thus, with three orientations the five error parameters $\phi_E$, $\phi_N$, $\phi_Z$ $\delta L$, and $\gamma_Z$ are obtained, the first three providing alignment of the inertial system with respect to local geodetic coordinates, the last two providing partial calibration of the antenna baseline.

A north direction of arrival with inertial system/antenna baseline in orientation #4, according to FIG. 12, permits the quantity $(\phi_E-\gamma_y)$ to be determined. Since $\phi_E$ has been measured, $\gamma_y$ can be determined. The antenna baseline is now fully calibrated with respect to the inertial system.

In summary, of the six error parameters that must be determined in order to align the inertial system with respect to local geodetic coordinates and to calibrate the antenna baseline with respect to the inertial reference coordinate axes, $\phi_E$ and $\phi_N$ are determined by a rotation about the approximate U axis. The remaining error parameters $\phi_Z$, $\delta L$, $\gamma_y$, and $\gamma_Z$ are obtained by measuring the difference in phase of radio waves received at the two antennas from one or more radio-wave sources and for one or more orientations of the inertial system/antenna baseline. In general, when $\phi_E=\phi_{N=0}$, the phase difference $\Phi$ due to the four error parameters $\phi_Z$, $\delta L$, $\gamma_y$, $\gamma_Z$, can be expressed as a function $\Phi$ of $\phi_Z$, $\delta L$, $\gamma_y$, $\gamma_Z$, $\Psi_n$, and $S_m$.

$$\Phi=\Phi(\phi_z, \delta L, \gamma_y, \gamma_z, \Psi_n, S_m) \tag{3}$$

where $\Psi_n$ is inertial reference system/antenna baseline orientation #n and $S_m$ is radio-wave source #m. By measuring $\Phi$ for four different combinations of orientation and source, one obtains four equations in four unknowns, and one can determine the values of $\phi_Z$, $\delta L$, $\gamma_y$, and $\gamma_z$. For example, one could use one radio-wave source and measure the phase differences associated with four different orientations, as described above. One could also use one orientation and measure the phase differences associated with four different radio-wave sources. Still another option would be to use two radio-wave sources and two orientations and measure the phase differences associated with the four combinations of orientation and radio-wave source.

The description of the invention thus far has assumed a two-antenna array, The invention is also applicable to more complicated linear, two-dimensional, and three-dimensional arrays. In the case of arrays with more than two antennas, the calibration procedure can be accomplished by subdividing the array into antenna pairs and for each such pair, proceeding as described above. The array can also be handled as a whole whereby the phases of the signals received at the various antennas, rather than phase differences associated with antenna pairs, constitute the measured data.

The apparatus 1 for practicing the method of calibration described above is shown in FIG. 13. The inertial reference system 3 consists of the reference unit 5 and the orientation unit 7. The reference unit 5 provides the means for establishing a three-axis inertial reference coordinate system and for maintaining the coordinate system in a specified orientation relative to the local geodetic coordinate system. The reference system 5 also provides its orientation relative to the inertial reference coordinate system. The techniques for performing these function are wellknown in the art and will not be detailed here.

The orientation unit 7 is attached to the reference unit and contains mechanisms that permit the orientation unit 7 to assume any specified orientation relative to the inertial reference coordinate system. Here also, the techniques for performing this function are numerous and well-known in the art and will not be detailed here.

The antenna array 9 is fixedly attached to the orientation unit 7. The radio signals received by each antenna in the array are separated by filtering or other appropriate procedures and the phase of the carrier of each radio signal is measured by the phase measuring unit 11.

Overall control of the apparatus 1 is exercised by the computer 13. The computer 13 issues commands to the inertial reference system 3 and the phase measurement unit 11 by means of the control bus 15 and receives or transmits data by means of the data bus 17. The user of the apparatus 1 introduces programs, data, and commands into the computer 13 and obtains status information and data from the computer by means of the input/output unit 19.

Figure 14:
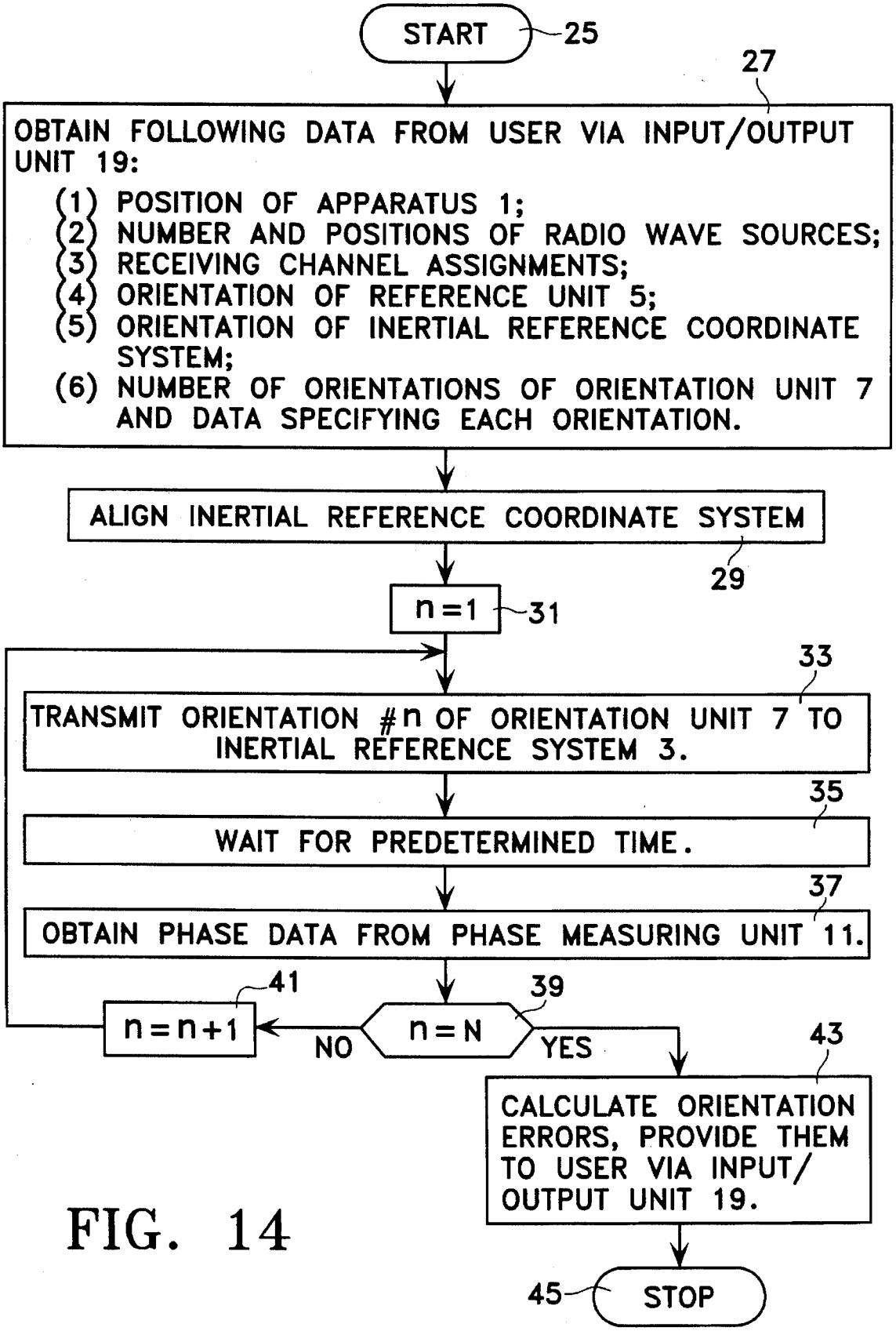
FIG. 14 shows a flow diagram that defines the functions performed by the computer that is utilized in the invention.

The flow diagram for the program that controls the operations of the computer 13 is shown in FIG. 14. The user initiates the process in step 25 by means of the input/output unit and in step 27 provides (1) the position of the apparatus 1, (2) the number M of radio-wave sources to be used in calibrating the antenna array 9 together with the positions of the radio-wave sources, (3) the receiving channel in the phase measuring unit 11 to be assigned to each radio-wave source together with tuning and selection data for each channel, (4) the orientation of the reference unit 5 in local geodetic coordinates, (5) the orientation of the inertial reference coordinate system relative to the local geodetic coordinate system, and (5) the number N of orientations to be used in calibrating the antenna array together with the data specifying each orientation in the inertial reference coordinate system.

The computer 13 aligns the inertial reference coordinate system in the specified orientation relative to the local geodetic coordinate system in step 29.

The index n is set equal to 1 in step 31 and in step 33 orientation data for orientation #n is transmitted to the reference unit 5 which causes the orientation unit 7 to assume the specified orientation.

In step 35 the computer 13 waits for a predetermined time sufficient for the antenna array to be properly oriented and for the phases of the received radio waves to be measured.

In step 37 the computer 13 obtains the phase data from the phase measuring apparatus. In step 39 the computer 13 tests the value of n to see if it equals N, the number of orientations to be used in the calibration process. If it does not, it increments n in step 41 and repeats steps 33–39.

If n equals N, the computer 13 calculates the orientation errors of the antenna array in step 43. This data is available to the user via the input/output unit 19. The process is terminated at step 45.

What is claimed is:

1. A method for determining the errors in the orientation coordinates of an antenna array in a known location using radio waves from one or more sources having known positions, the antenna array comprising at least two antennas, the orientation of the antenna array being with respect to a reference coordinate system established by a reference unit, the method comprising the steps:

placing the antenna array in one or more specified orientations relative to a reference coordinate system;

measuring the phase of each radio wave received by each of the antennas in the antenna array from the one or more radio-wave sources for each orientation of the antenna array;

determining the errors in the array orientation coordinates using the measured phases.

2. The method of claim 1 further comprising the step:

determining the errors in the spacings of the antennas in the array using the measured phases.

3. The method of claim 1 further comprising the step:

determining the errors in the orientation coordinates of the reference coordinate system using the measured phases.

4. The method of claim 1 wherein there is a plurality of radio-wave sources and one orientation of the antenna array.

5. The method claim 1 wherein there is one radio-wave source and there is a plurality of orientations of the antenna array.

6. The method of claim 5 wherein the number of antennas in the array are two and the number of orientations of the antenna array is four, the coordinate axes of the antenna array coordinate system being denoted by the symbols x, y, and z, the two antennas being on the x-axis, the first orientation corresponding to the direction of arrival of the radio wave being along the y-axis, the second orientation being the first orientation rotated ninety degrees about the y-axis, the third orientation being the second orientation rotated ninety degrees about the x-axis, the fourth orientation being the third orientation rotated ninety degrees about the y-axis.

7. The method of claim 5 wherein the number of antennas in the array are two and the number of orientations of the antenna array is four, the coordinate axes of the antenna array coordinate system being denoted by the symbols x, y, and z, the two antennas being on the x-axis, the first orientation corresponding to the direction of arrival of the radio wave being along the x-axis, the second orientation being the first orientation rotated ninety degrees about the z-axis, the third orientation being the first orientation rotated ninety degrees about the y-axis, the fourth orientation being the second orientation rotated ninety degrees about the y-axis.

8. The method of claim 5 wherein the number of antennas in the array are two and the number of orientations of the antenna array is four, the coordinate axes of the antenna array coordinate system being denoted by the symbols x, y, and z, the two antennas being on the x-axis, the first orientation corresponding to the direction of arrival of the radio wave being along the y-axis, the second orientation being the first orientation rotated ninety degrees about the z-axis, the third orientation being the first orientation rotated ninety degrees about the y-axis, the fourth orientation being the second orientation rotated ninety degrees about the y-axis.

9. The method of claim 1 wherein the step of determining the errors in the array orientation coordinates is performed by determining the errors in the orientation coordinates of one or more pairs of antennas that comprise the antenna array.

10. The method of claim 2 wherein the step of determining the errors in the spacings of the antennas in the array is performed by determining the errors in the spacings of one or more pairs of antennas that comprise the antenna array.

11. An apparatus for determining the errors in the orientation coordinates of an antenna array using radio waves from one or more sources having known positions, the antenna array comprising at least two antennas, the apparatus comprising:

a reference unit;

an orientation unit on which the antenna array is mounted, the orientation unit assuming an orientation relative to the reference unit in accordance with an orientation input;

a phase measuring unit which measures the phase of each radio wave received by each of the antennas in the antenna array from the one or more radio-wave sources;

a computer which provides a sequence of one or more predetermined orientation inputs to the orientation unit and obtains the measured phases for each orientation of the orientation unit from the phase measuring unit, computer determining the errors in the array orientation coordinates using the measured phase.

12. The apparatus of claim 11 wherein the computer also determines the errors in the spacings of the antennas in the antenna array using the measured phases.

13. The apparatus of claim 11 wherein the computer also determines the errors in the orientation coordinates of the reference unit using the measured phases.

14. The apparatus of claim 11 wherein there are a plurality of radio-wave sources and the computer supplies one orientation input to the orientation unit.

15. The apparatus of claim 11 wherein there is one radio-wave source and the computer supplies a plurality of orientation inputs to the orientation unit.

16. The apparatus of claim 15 wherein the number of antennas in the array are two and the number of orientation inputs supplied by the computer to the orientation unit is four, the coordinate axes fixed with respect to the orientation unit being denoted by the symbols x, y, and z, the two antennas being on the x-axis, the first orientation of the orientation unit corresponding to the direction of arrival of the radio wave being along the y-axis, the second orientation being the first orientation rotated ninety degrees about the y-axis, the third orientation being the second orientation rotated ninety degrees about the x-axis, the fourth orientation being the third orientation rotated ninety degrees about, the y-axis.

17. The apparatus of claim 15 wherein the number of antennas in the array are two and the number of orientation inputs supplied by the computer to the orientation unit is four, the coordinate axes fixed with respect to the orientation unit being denoted by the symbols x, y, and z, the two antennas being on the x-axis, the first orientation of the orientation unit corresponding to the direction of arrival of the radio wave being along the x-axis, the second orientation being the first orientation rotated ninety degrees about the z-axis, the third orientation being the first orientation rotated ninety degrees about the y-axis, the fourth orientation being the second orientation rotated ninety degrees about the y-axis.

18. The apparatus of claim 15 wherein the number of antennas in the array are two and the number of orientation inputs supplied by the computer to the orientation unit is four, the coordinate axes fixed with respect to the orientation unit being denoted by the symbols x, y, and z, the two antennas being on the x-axis, the first orientation of the orientation unit corresponding to the direction of arrival of the radio wave being along the y-axis, the second orientation being the first orientation rotated ninety degrees about the z-axis, the third orientation being the first orientation rotated ninety degrees about the y-axis, the fourth orientation being the second orientation rotated ninety degrees about the y-axis.

19. The apparatus of claim 11 wherein the computer determines the errors in the array orientation coordinates by determining the errors in the orientation coordinates of one or more pairs of antennas that comprise the antenna array.

20. The apparatus of claim 12 wherein the computer determines the errors in the spacings of the antennas in the antenna array by determining the errors in the spacings of one or more pairs of antennas that comprise the antenna array.

* * * * *